US008402914B2

(12) United States Patent
Pei

(10) Patent No.: US 8,402,914 B2
(45) Date of Patent: Mar. 26, 2013

(54) DIP COATING APPARATUS

(75) Inventor: Shao-Kai Pei, Taipei Hsien (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 371 days.

(21) Appl. No.: 12/883,189

(22) Filed: Sep. 16, 2010

(65) Prior Publication Data

US 2011/0253041 A1 Oct. 20, 2011

(30) Foreign Application Priority Data

Apr. 19, 2010 (TW) ..... 99112199 A

(51) Int. Cl.

| | |
|---|---|
| ***B05C 3/00*** | (2006.01) |
| ***B05C 19/02*** | (2006.01) |
| *B05C 3/02* | (2006.01) |
| *B05C 13/00* | (2006.01) |
| *B05C 13/02* | (2006.01) |
| *B05C 21/00* | (2006.01) |
| *B05D 3/02* | (2006.01) |
| *B05D 3/04* | (2006.01) |

(52) U.S. Cl. ..... 118/423

(58) Field of Classification Search ..... 118/400, 118/416, 423, 425, 427, 429, 500, 66; 427/372.2, 427/377, 331

See application file for complete search history.

(56) References Cited

U.S. PATENT DOCUMENTS

| | | | | |
|---|---|---|---|---|
| 4,267,208 | A * | 5/1981 | Ireland | 427/154 |
| 5,299,584 | A * | 4/1994 | Miyazaki et al. | 134/56 R |
| 5,514,214 | A * | 5/1996 | Joel et al. | 118/52 |
| 5,820,673 | A * | 10/1998 | Sentilles et al. | 118/319 |
| 6,241,505 | B1 * | 6/2001 | Buazza et al. | 425/174.4 |

* cited by examiner

*Primary Examiner* — Dah-Wei Yuan
*Assistant Examiner* — Binu Thomas
(74) *Attorney, Agent, or Firm* — Altis Law Group, Inc.

(57) ABSTRACT

A dip coating apparatus includes a container, a separating plate, an air intake, at least one driving module, and at least one carrying base. The separating plate separates the container into a first chamber and a second chamber, and defines a through opening communicating the two chambers. The first chamber is configured for drying workpieces, and the second chamber is configured for carrying coating liquid to coat the workpieces. The air intake takes drying air into the first chamber. The driving module is mounted on the separating plate. The carrying base carries the workpieces, and is connected to the driving module and positioned in the second chamber. Driven by the driving module, the carrying base is able to dip the workpieces into the coating liquid for coating, and is able to cover the through opening and expose the workpieces to the first chamber for drying.

17 Claims, 4 Drawing Sheets

DIP COATING APPARATUS

BACKGROUND

1. Technical Field

The present disclosure relates to coating apparatuses and, particularly, to a dip coating apparatus.

2. Description of Related Art

Dip coating apparatuses are widely used for coating films on the surfaces of workpieces (e.g., lenses). Generally, in a dip coating process, the dip coating apparatus carries coating liquid, the workpieces are dipped into the coating liquid for a predetermined period of time, then taken out from the dip coating apparatus and dried for another predetermined period of time in an oven, thus to accomplish the coating process. Yet, the dipping process and the drying process are respectively accomplished in separate apparatuses. It is needed to transport the workpieces to the oven after the dipping process. Thereby, the full coating time is prolonged, and the workpieces maybe polluted in the transporting process. Thus, what is needed is a dip coating apparatus which overcomes the shortcomings mentioned above.

BRIEF DESCRIPTION OF THE DRAWINGS

Many aspects of the embodiments can be better understood with reference to the following drawing. The components in the drawing are not necessarily drawn to scale, the emphasis instead being placed upon clearly illustrating the principles of the present disclosure.

DETAILED DESCRIPTION

Figure 1:
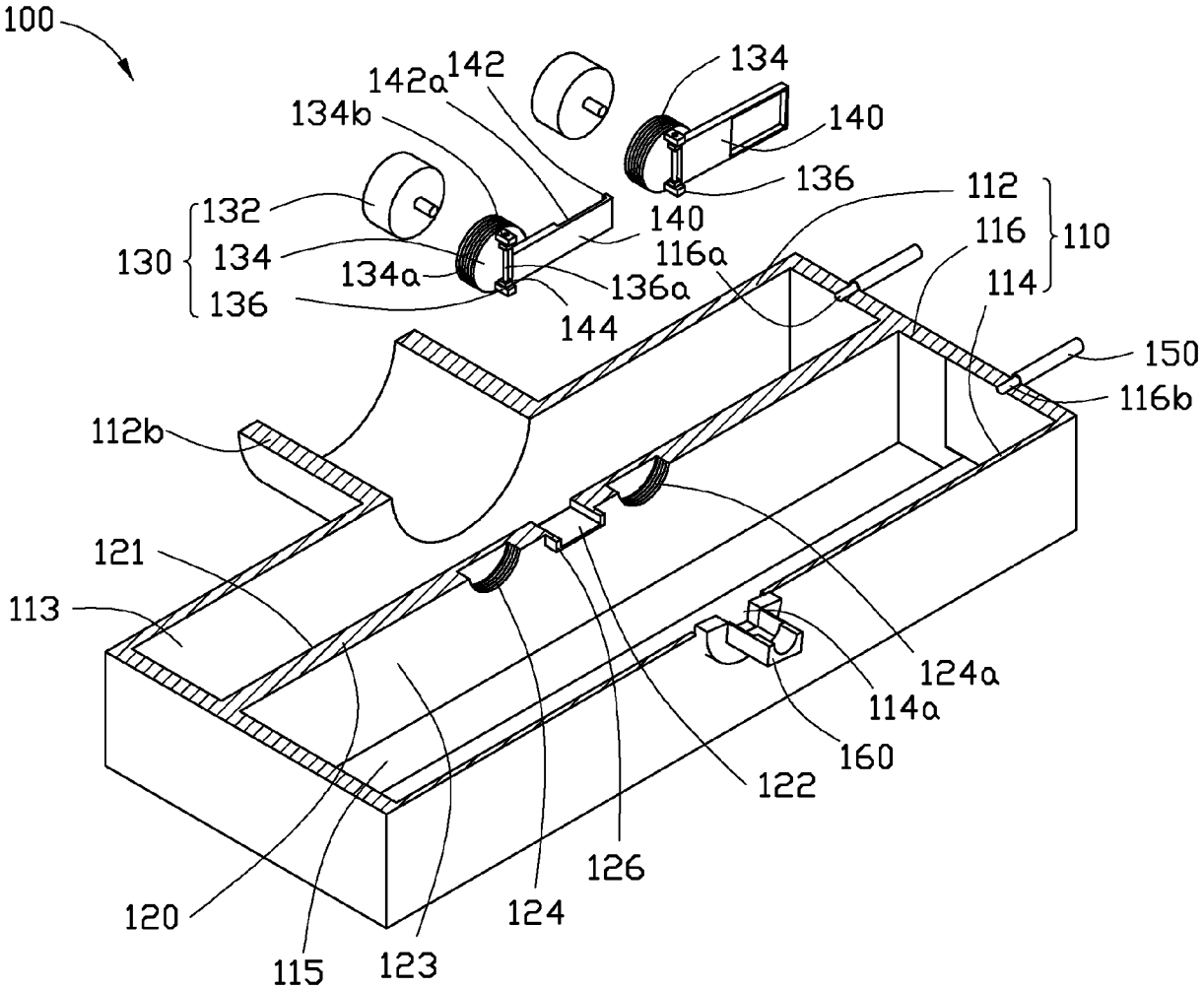
FIG. 1 is a partially exploded view of a dip coating apparatus partially cut away for better viewing according to an exemplary embodiment.
Figure 2:
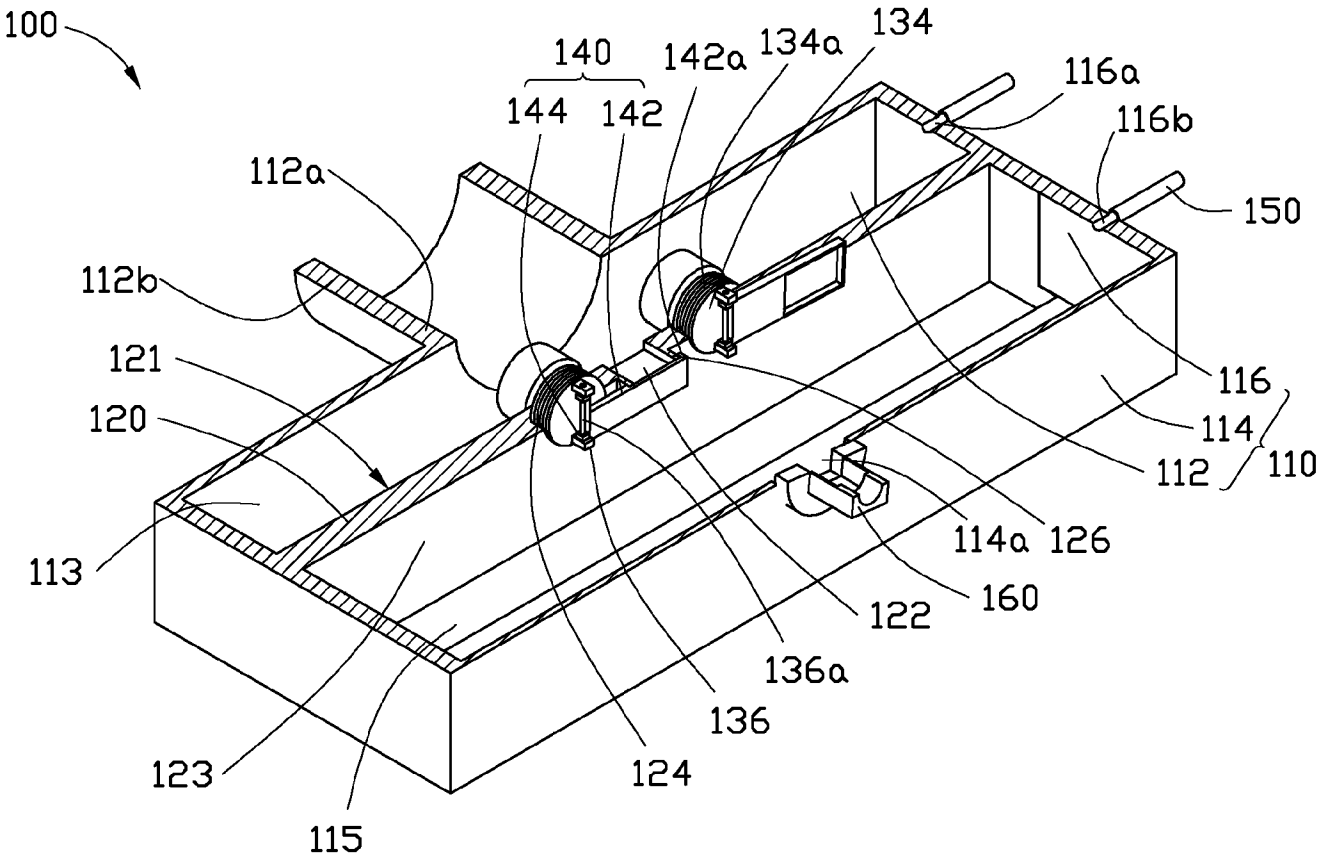
FIG. 2 is a cut-away, isometric view of the dip coating apparatus of FIG. 1.

Referring to FIGS. 1-2, a dip coating apparatus 100 according to an exemplary embodiment is disclosed. The dip coating apparatus 100 includes a container 110, a separating plate 120, at least one driving module 130, at least one carrying base 140, at least one air intake tube 150, and a feed valve 160. The separating plate 120 is set in the container 110 and divides the container 110 into a first chamber 113 and a second chamber 115. The separating plate 120 defines a through opening 122 for communicating the first chamber 113 with the second chamber 115. The at least one driving module 130 is set on the separating plate 120. The at least one carrying base 140 is positioned in the second chamber 115 and connected to the at least one driving module 130, to cover the opening 122 driven by the driving module 130. The at least one air intake tube 150 is set on a sidewall 116 of the container 110 for taking air into the first chamber 113 or the second chamber 115. The feed valve 160 is set on a bottom plate 114 of the container 110 for taking coating liquid into the second chamber 115.

In detail, the container 110 includes a top plate 112 opposite to the bottom plate 114. The sidewall 116 is connected between the top plate 112 and the bottom plate 114 to form a closed chamber including the first chamber 113 and the second chamber 115. The top plate 112 defines a through air outlet 112*a*. An air outlet tube 112*b* is aligned with and communicated with the air outlet 112*a* outside the container 110. In this embodiment, the air outlet tube 112*b* and the top cover 112 is integrally formed each other. The bottom plate 114 defines a through feed hole 114*a*, the feed valve 160 is set on the feed hole 114*a*. The sidewall 116 defines a first air intake 116*a* communicated with the first chamber 113, and a second air intake 116*b* communicated with the second chamber 115. The first air intake 116*a* is used for taking drying air into the first chamber 113. The second air intake 116*b* is used for taking compressed air into the second chamber 115.

The separating plate 120 is connected to a middle portion of the sidewall 116. The separating plate 120 includes a top surface 121 and a bottom surface 123. The opening 122 extends from the top surface 121 to the bottom surface 123. The separating plate 120 defines at least one receiving groove 124 on the bottom surface 123 adjacent to the opening 122. In this embodiment, two receiving grooves 124 are located symmetrically at two sides of the opening 122. Internal threads 124*a* are formed on inner sidewalls of the receiving grooves 124. A closed wall 126 is projected from the bottom surface 123 and surrounds the opening 122.

The at least one driving module 130 is correspondingly received in the at least one receiving groove 124. Each driving module 130 includes a first driving motor 132, a rotatable disc 134, and a second driving motor 136. The first driving motor 132 is mounted on the top surface 121 of the separating plate 120. The rotatable disc 134 is received in the receiving groove 124 and driven by the first driving motor 132. The rotatable disc 134 includes an external thread 134*a* engaged with the internal thread 124*a*. When the rotatable disk 134 is driven to rotate by the first driving motor 132, the engaged threads 124*a*, 134*a* make the rotatable disk 134 move out or into the receiving groove 124. The rotatable disc 134 includes a seat 134*b* facing to the second chamber 115. The second driving motor 136 includes a rotatable drive shaft 136*a* mounted on the seat 134*b*.

Each carrying base 140 includes a base plate 142 and two connecting blocks 144 connected to two opposite ends of the base plate 142. The connecting blocks 144 are further connected to the rotatable drive shaft 136*a* of the second driving motor 136. Thus, each carrying base 140 can be driven to rotate around the rotatable drive shaft 136*a* by the corresponding second driving motor 136. In this embodiment, two carrying bases 140 are connected to two corresponding second driving motors 136. Each base plate 142 defines a recess 142*a* for receiving and fixing workpieces therein. When one of the carrying bases 140 covers the opening 122 of the separating plate 120, the recess 142*a* is aligned with the opening 122 and receives the closed wall 126.

In this embodiment, there are two air intake tubes 150 mounted on the sidewall 116 of the container 110. One of the air intake tubes 150 is communicated with the first air intake 116*a*, the other air intake tube 150 is communicated with the second air intake 116*b*.

Figure 3:
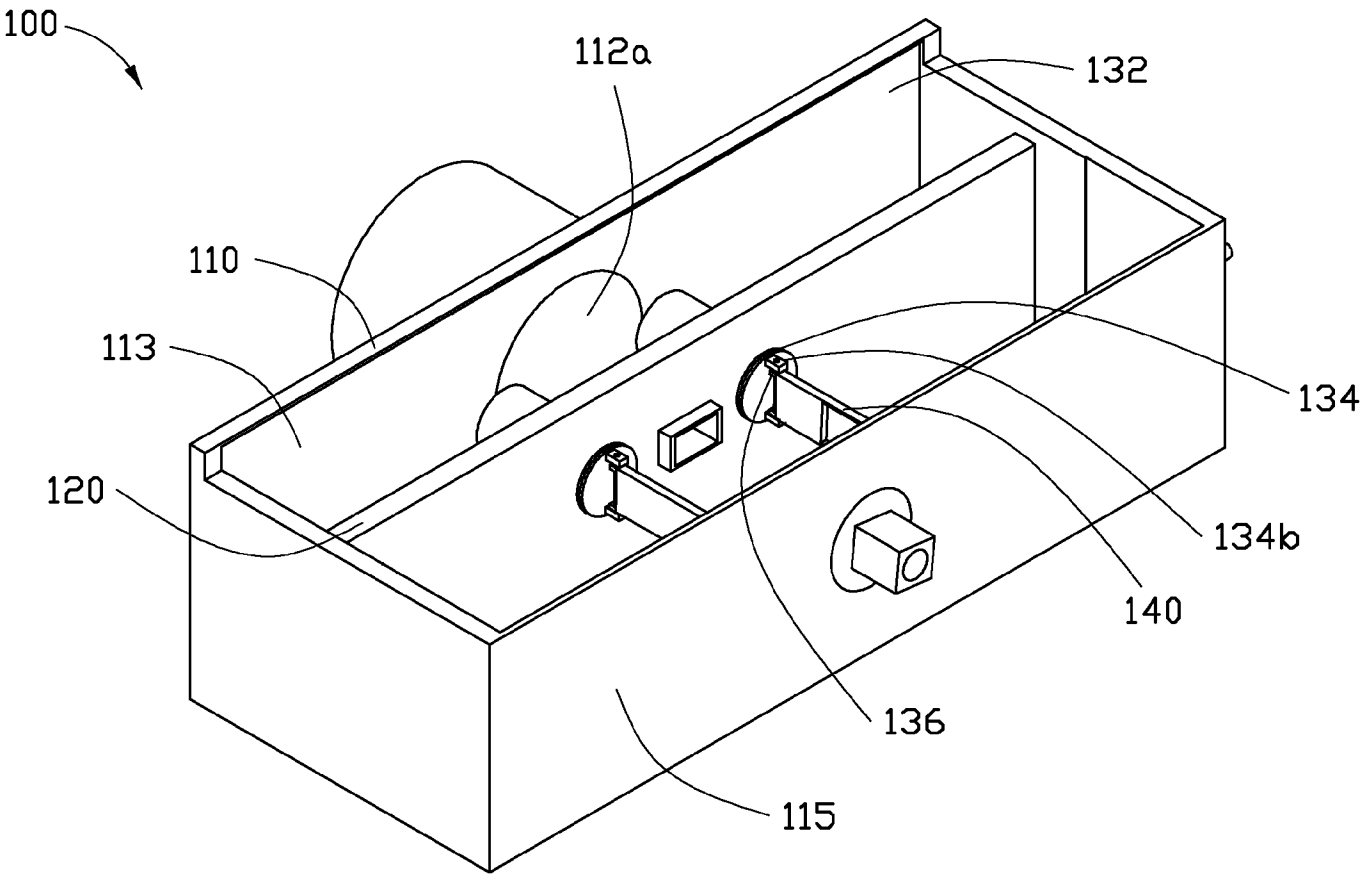
FIG. 3 is an isometric view of the dip coating apparatus of FIG. 1 with a cover removed, showing the dip coating apparatus in a dipping process.
Figure 4:
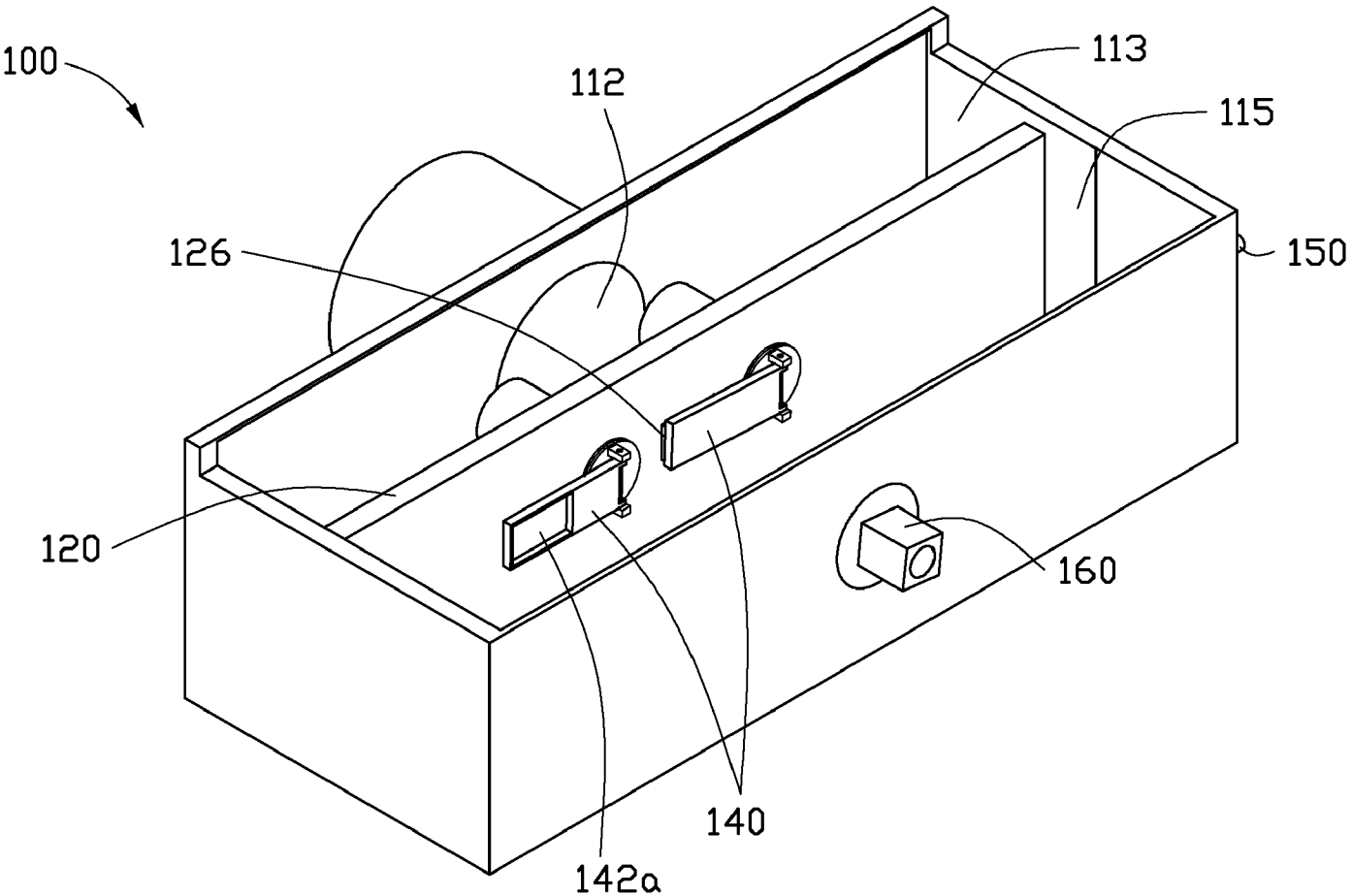
FIG. 4 is similar to FIG. 3, but showing the dip coating apparatus in a drying process.

Referring to FIGS. 3 and 4, initially in a coating process, the second driving motors 136 drive the corresponding carrying bases 140 carrying workpieces to rotate to a position perpendicular to the separating plate 120 and adjacent to the coating liquid. Then the first driving motors 132 drive the rotatable discs 134 to rotate and move out from the receiving grooves 124, thus to dip the workpieces on the carrying bases 140 into the coating liquid for coating a film thereon. After a predetermined period of time, the first driving motors 132 reverse the rotatable discs 134 to the receiving grooves 124, thus to pull the workpieces out from the coating liquid. The air intake tube 150 that is communicated with the second air intake 116*b* takes compressed air into the second chamber 115 to volatilize the coating liquid. Thus, the volatilized coating material can supplement the film coated on the workpieces. When the carrying bases 140 carrying the workpieces leave the coating liquid fully, one of the second driving motors 136 reverses the corresponding carrying base 140 to cover the opening 122. The recess 142*a* of the carrying base 140 is aligned with the opening 122. Then, the air intake tube 150 communicated with the first air intake 116*a* takes drying air into the first chamber 113. The drying air flows into the opening 122 and dries the workpieces in the recess 142*a*. After another predetermined period of time, the workpieces are fully dried, the second driving motor 136 drives the carrying base 140 to rotate and leave the opening 122, at last, the other workpieces carried on the other carrying base 140 is dried by the same means mentioned above. The waste air produced in the coating process is vented from the air outlet 112*a* and the air outlet tube 112*b*.

Moreover, it is to be understood that the disclosure may be embodied in other forms without departing from the spirit thereof. Thus, the present examples and embodiments are to be considered in all respects as illustrative and not restrictive, and the disclosure is not to be limited to the details given herein.

What is claimed is:

1. A dip coating apparatus for coating workpieces, comprising:

a container;

a separating plate mounted in the container and separating the container into a first chamber and a second chamber, the separating plate defining a through opening communicating the first chamber with the second chamber, wherein the first chamber is configured for drying the workpieces, the second chamber is configured for carrying coating liquid to coat the workpieces, the separating plate comprises a top surface and a bottom surface, the through opening extends from the top surface to the bottom surface, the separating plate defines at least one receiving groove on the bottom surface adjacent to the through opening, and an internal thread is formed on an inner sidewall of the at least one receiving groove;

a first air intake communicated with the first chamber for taking drying air into the first chamber;

at least one driving module mounted on the separating plate; and at least one carrying base positioned in the second chamber and configured for carrying the workpieces, each carrying base connected to a corresponding driving module;

wherein the at least one driving module is capable of driving the at least one carrying base to dip the workpieces into the coating liquid for coating, the at least one driving module is also capable of driving the at least one carrying base to cover the through opening such that the workpieces expose to the first chamber for drying through the through opening.

2. The dip coating apparatus of claim 1, further comprising a feed valve mounted on a sidewall of the second chamber for taking the coating liquid into the second chamber.

3. The dip coating apparatus of claim 1, wherein the container comprises a top plate, a bottom plate and a sidewall, the sidewall is connected between the top plate and the bottom plate to form a closed chamber comprising the first chamber and the second chamber.

4. The dip coating apparatus of claim 3, wherein the top plate defines a through air outlet.

5. The dip coating apparatus of claim 4, further comprising an air outlet tube aligned with and communicated with the air outlet outside the container.

6. The dip coating apparatus of claim 1, further comprising a second air intake communicated with the second chamber.

7. The dip coating apparatus of claim 6, further comprising two air intake tubes mounted on a sidewall of the container and communicated with the first air intake and the second air intake respectively.

8. The dip coating apparatus of claim 1, wherein the at least one driving module comprises a first driving motor, a rotatable disc, and a second driving motor, the first driving motor is mounted on the top surface of the separating plate, the rotatable disc is received in a corresponding receiving groove and driven by the first driving motor, the rotatable disc comprises an external thread engaged with the internal thread of the corresponding receiving groove, the rotatable disc comprises a seat facing to the second chamber, the second driving motor is mounted on the seat and comprises a rotatable drive shaft.

9. The dip coating apparatus of claim 8, wherein the at least one carrying base comprises a base plate and two connecting blocks connected to two opposite ends of the base plate, the two connecting blocks are further connected to the rotatable drive shaft of the second driving motor.

10. The dip coating apparatus of claim 9, wherein the base plate defines a recess for receiving and fixing the workpieces, when the at least one carrying base covers the through opening of the separating plate, the recess is aligned with the through opening.

11. The dip coating apparatus of claim 10, wherein the separating plate comprises a closed wall projected from the bottom surface and surrounding the through opening, when the at least one carrying base covers the through opening of the separating plate, the recess receives the closed wall.

12. A dip coating apparatus for coating workpieces, comprising:

a container;

a separating plate positioned in the container and separating the container into a first chamber and a second chamber, the separating plate defining a through opening communicating the first chamber with the second chamber, wherein the separating plate comprises a top surface and a bottom surface, the through opening extends from the top surface to the bottom surface, the separating plate defines at least one receiving groove on the bottom surface adjacent to the through opening, an internal thread is formed on an inner sidewall of the at least one receiving groove;

a plurality of driving modules positioned on the separating plate; and a plurality of carrying bases positioned in the second chamber and configured for carrying the workpieces, each carrying base connected to a corresponding driving module;

wherein each driving module is capable of rotating a corresponding carrying base to cover the through opening such that the workpieces expose to the first chamber through the through opening, the driving module is also capable of rotating the carrying base to open the through opening such that the workpieces expose to the second chamber.

13. The dip coating apparatus of claim 12, wherein the container comprises a top plate, a bottom plate and a sidewall, the sidewall is connected between the top plate and the bottom plate to form a closed chamber comprising the first chamber and the second chamber.

14. The dip coating apparatus of claim 12, wherein the at least one driving module comprises a first driving motor, a rotatable disc, and a second driving motor, the first driving motor is mounted on the top surface of the separating plate, the rotatable disc is received in a corresponding receiving groove and driven by the first driving motor, the rotatable disc comprises an external thread engaged with the internal thread of the corresponding receiving groove, the rotatable disc comprises a seat facing to the second chamber, the second driving motor is mounted on the seat and comprises a rotatable drive shaft.

15. The dip coating apparatus of claim 14, wherein the at least one carrying base comprises a base plate and two connecting blocks connected to two opposite ends of the base plate, the two connecting blocks are further connected to the rotatable drive shaft of the second driving motor.

16. The dip coating apparatus of claim 15, wherein the base plate defines a recess for receiving and fixing the workpieces, when the at least one carrying base covers the through opening of the separating plate, the recess is aligned with the through opening.

17. The dip coating apparatus of claim 16, wherein the separating plate comprises a closed wall projected from the bottom surface and surrounding the through opening, when the at least one carrying base covers the through opening of the separating plate, the recess receives the closed wall.

* * * * *